United States Patent [19]

Bodi

[11] Patent Number: 4,798,294

[45] Date of Patent: Jan. 17, 1989

[54] SHIPPING TRAY ASSEMBLY FOR AN ARTICLE HAVING CASTERS

[75] Inventor: Richard Bodi, Knoxville, Tenn.

[73] Assignee: North American Philips Corp, New York, N.Y.

[21] Appl. No.: 91,673

[22] Filed: Aug. 31, 1987

[51] Int. Cl.[4] ..... B65N 19/42

[52] U.S. Cl. ..... 206/600; 108/55.3; 206/320; 206/583; 220/1.5; 248/346

[58] Field of Search ..... 206/320, 326, 335, 592, 206/386, 594, 597, 521, 598, 583, 586, 591, 600; 358/229; 248/346; 229/23 R; 312/7.2; 217/37; 108/55.1, 55.3, 56.1, 56.3, 53.1; 220/1.5

[56] References Cited

U.S. PATENT DOCUMENTS

| | | | |
|---|---|---|---|
| 1,841,025 | 1/1932 | Gomes | 206/320 |
| 2,009,739 | 7/1935 | Lang et al. | 206/320 |
| 2,253,428 | 8/1941 | Henderson | 206/326 |
| 2,321,063 | 6/1943 | Bohnlee | 206/320 |
| 2,331,753 | 10/1943 | Wohlers | 206/326 |
| 2,438,256 | 3/1948 | Stein | 312/7.2 X |
| 2,633,982 | 4/1953 | Addison | 108/55.3 X |
| 2,783,930 | 3/1957 | Riley | 206/320 X |
| 3,471,116 | 10/1969 | De Cheme | 206/320 X |
| 3,602,376 | 8/1971 | DePiano | 214/1 |
| 3,661,318 | 5/1972 | Miller et al. | 229/23 |
| 3,934,720 | 1/1976 | Kratochvil, Jr. | 206/326 |
| 4,079,907 | 3/1978 | Mykleby | 248/119 |
| 4,267,780 | 5/1981 | Candella | 206/598 X |
| 4,383,609 | 5/1983 | Lochmiller | 206/386 |
| 4,610,355 | 9/1986 | Maurer | 206/386 |

*Primary Examiner*—Stephen Marcus
*Assistant Examiner*—Bryon Gehman
*Attorney, Agent, or Firm*—Robert T. Mayer

[57] ABSTRACT

A shipping tray assembly for use in shipping an article having casters whereby a section of the tray assembly can be removed so that the article may be rolled out of the tray on its casters.

10 Claims, 1 Drawing Sheet

SHIPPING TRAY ASSEMBLY FOR AN ARTICLE HAVING CASTERS

This is an invention in the packaging art. More particularly, it involves a carton bottom, herein called a shipping tray assembly, which is useful with articles shipped with casters.

Large projection television sets are shipped in corrugated cartons and are difficult to unpack. After the sides and top have been removed from around a particular set it still rests on it bottom shipping tray assembly. Because these sets weigh close to 300 pounds it is difficult to lift them off these assemblies. This problem is aggravated by the fact that there are no handles on the sets which can be used in lifting them. The bottom assemblies can be cut away from the sets but in doing so there is always the danger of damaging the set. Moreover, the problem is further exacerbated by the fact that the casters on the bottoms of the sets press into the corrugated fibreboard of the bottom assemblies and make it more difficult to lift the sets.

It is an object of this invention to provide a shipping tray assembly for projection television sets and other castered articles which are easier to unpack.

One of the advantages of the invention is that projection television sets and similar castered articles shipped in assemblies made in accordance with the invention need not be lifted to be unpacked.

Another advantage of the invention is that by using the assembly of the invention one man can more readily remove a castered article from a bottom shipping tray assembly than a number of men could do with assemblies of earlier designs.

One of the features of the invention is that the casters of a set are used in removing it from its bottom assembly.

Another advantage of the invention is provided by the use of a Masonite or wood panel as part of the carton bottom or shipping tray assembly. This adds strength to the bottom of a shipping carton. It also provides protection against damage to the corners and the sides of the bottom of an article shipped in the tray assembly.

In accordance with the invention there is provided a shipping tray assembly for use in shipping articles having casters extending below their bottoms. The tray comprises a first surface and a first raised segment on the surface for supporting a first portion of the bottom of an article. A second raised segment is also provided on the support for supporting a second portion of the bottom of an article. The raised segments are high enough so that when an article is supported on them its casters are out of contact with the surface. Also provided are holding means holding the first and second segments in fixed relationship to one another. The holding means are releasable whereby the fixed relationship can be changed.

Other objects, features and advantages of the invention will be apparent to those skilled in the art from the following description when considered in conjunction with the appended claims and the accompanying drawing in which:

Figure 1:
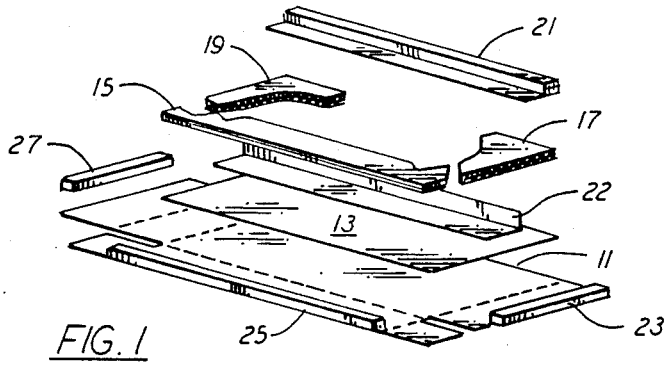
FIG. 1 is an exploded diagrammatic view of a shipping tray assembly in accordance with the construction of the invention.

Referring to FIG. 1 there is shown a sheet 11 of pre-formed corrugated fibreboard. Sheet 11 and the other elements shown in FIG. 1 are assembled into a box-like shipping tray as will be described. Above sheet 11 in the box-like tray is a panel 13, which may be either Masonite or wood. Located on top of panel 13 and fixed thereto such as by gluing is first raised corrugated segment 15. Segment 15 provides a support for a first portion of the bottom of a projection television set or similar article to be shipped in the assembled tray.

Also located on top of panel 13 but not fixed thereto are two built-up corrugated base elements 17 and 19. These form part of a second raised segment for supporting a second portion of the bottom of an article to be shipped in the tray. Base elements 17 and 19 are joined together by bar-shaped corrugated section 21 which is fixed atop them such as by gluing. As will be understood since section 21 is atop elements 17 and 19 and since there is a space between elements 17 and 19 that part of section 21 above the space can serve as a handle. The handle can be used for pulling the second raised segment out of the tray during unpacking, as will be explained. The short leg of L-shaped panel 22 (see FIGS. 1 and 2) is glued to the front of section 21. Section 21 and panel 22 also form part of the second raised segment. The first and second raised segments surround a depression in the assembly which accommodates the casters of an article to be shipped in the tray. The segments are high enough to keep the casters off the top surface of panel 13 during shipment.

Additional bar-shaped corrugated sections 23, 25, and 27 are glued to flaps of sheet 11. As those skilled in the art will understand, sections 23, 25 and 27 could be rolled up integral parts of sheet 11. These sections together with bar-shaped element 21 provide lateral protection for the sides of an article to be shipped in the tray. By appropriately folding sheet 11 along some of the dotted lines shown in FIG. 1 and other lines not shown, the assembly is formed.

Figure 2:
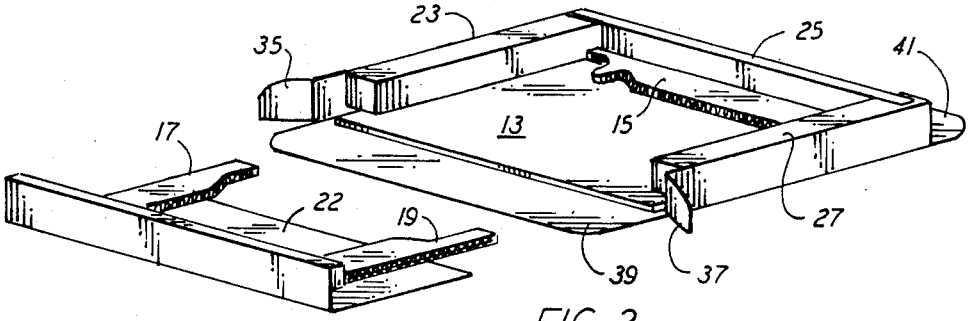
FIG. 2 is an exploded view of a partially assembled shipping tray assembly constructed in accordance with the invention.

FIG. 2 shows the tray after partial assembly. The tray of FIG. 2 is turned 180° from the orientation of the elements of FIG. 1 for ease of description. In the final assembly of the tray the side panel holding bar-shaped sections 23 and 27 are folded up to close those sides of the tray. The second raised segment is then slid into place with panel 22 on top of panel 13 and underneath sections 23 and 27. Flaps 35 and 37 are folded over and secured to the front of the short leg of panel 22 and to section 21 in a suitable manner, such as by gluing or stapling. A suitable covering carton 38 (FIG. 3) is mounted on the tray assembly to provide a complete package for a shipped article. Carton 38 is secured to the tray assembly by having flaps 39 and 41 secured thereto in a suitable manner, such as by gluing.

It is to be understood that flaps 35 and 37 are secured only to panel 22 and section 21 and not to any other element of the tray. Flaps 35 and 37 provide a holding means for the assembly which holds the first and second segments in fixed relationship to one another when the flaps are closed. In addition, the long leg of panel 22 being inserted under sections 23 and 27 assists in securing the first and second raised segments together during shipping.

Figure 3:
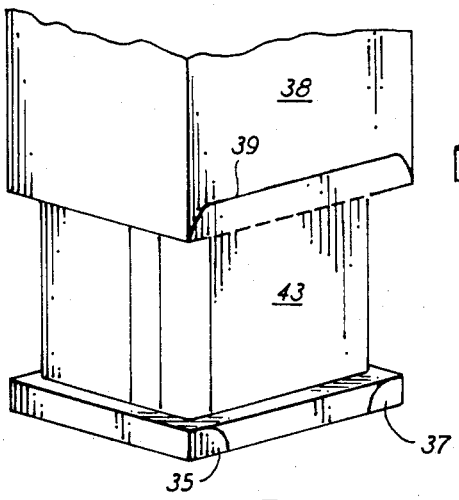
FIG. 3 is a diagrammatic segmental view of a shipping tray assembly holding a partially unpacked article.

In uncrating, flaps 39 and 41 are cut along dotted lines such as that shown in FIG. 3 for flap 39. Covering carton 38 can then be lifted off the crated article. By not being secured to anything but section 21 and panel 22, flaps 35 and 37 can be cut along the dotted lines on them shown in FIG. 3. After this is done, projection television set 43 in the tray is tipped away from bar section 21.

Figure 4:
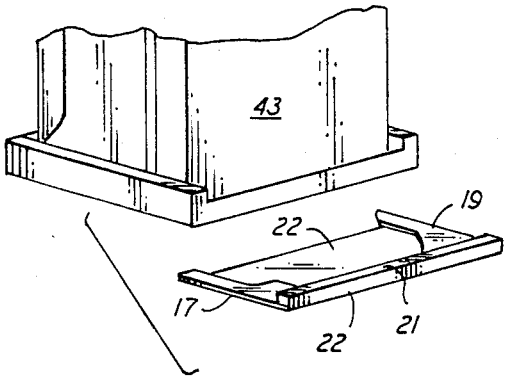
FIG. 4 is a diagrammatic segmental view of the shipping tray assembly and article of FIG. 3 further unpacked.

In the tipped condition, the bottom of projection television set 43 rests on first segment 15, bar section 21 may then be grasped by its handle and it together with base elements 17 and 19 and panel 22 can be pulled from the tray as shown in FIG. 4. Projection television set 43 may then be allowed to settle back so that at least some of its casters will rest on the top surface of panel 13. After that projection television set 43 may be rolled out of the tray through the opening provided by the removed second raised segment.

As can be seen, no damage is done to the tray assembly other than the cuts in flaps 35, 37, 39 and 41. Consequently, if an article is to be returned the tray assembly can be reused by taping or otherwise sealing these cuts.

It is understood that various modifications to the above described assembly will become evident to those skilled in the art and that the assembly described herein is for illustrative purposes and is not to be considered restrictive.

What is claimed is:

1. A shipping tray assembly for use in shipping an article having casters extending below its bottom, said tray assembly comprising a first surface, a first raised segment on said surface for supporting a first portion of the bottom of such an article, a second raised segment on said surface for supporting a second portion of the bottom of such an article, said raised segments being high enough so that when such an article is supported on them its casters are out of contact with said surface, and holding means holding said first and second segments in fixed relationship to one another, said holding means being releasable whereby said fixed relationship can be changed, said holding means upon being released enabling said second raised segment to be removed from said tray assembly thereby providing an opening in said assembly whereby an article with casters extending below its bottom and located inside said tray assembly can have its casters lowered onto said surface and can be rolled out of said assembly through said opening.

2. A shipping tray assembly as claimed in claim 1 wherein said first surface is located in a box-like unit comprised of a panel of fibreboard, said holding means being two flaps on said panel.

3. A shipping tray assembly as claimed in claim 2, wherein part of said second raised segment is capable of serving as a handle to aid in unpacking a box-like unit.

4. A shipping tray assembly as claimed in claim 3, wherein said second raised segment includes a wall and said flaps are secured to said wall and can be cut to enable said second raised segment to be removed from said box-like unit.

5. A shipping tray assembly as claimed in claim 4, wherein said first surface is one side of a Masonite panel.

6. A shipping tray assembly as claimed in claim 5, wherein said first segment is fixed to said Masonite panel.

7. A shipping tray assembly as claimed in claim 4, wherein said first surface is one side of a wood panel.

8. A shipping tray assembly as claimed in claim 7, wherein said first segment is fixed to said wood panel.

9. A shipping tray assembly as claimed in claim 4, wherein said second raised segment comprises two built up corrugated base elements with a space between them joined by a bar-shaped corrugated section, said section between said base elements serving as said handle.

10. A shipping tray assembly as claimed in claim 9, wherein said base elements and said bar section are joined together by gluing.

* * * * *